US005979975A

United States Patent [19]

Hiraoka

[11] Patent Number: 5,979,975

[45] Date of Patent: Nov. 9, 1999

[54] INFLATABLE PORTABLE SEAT CUSHION WITH SLIP COVER AND POUCH

[75] Inventor: Marc N. Hiraoka, Pasadena, Calif.

[73] Assignee: Marc Nari Hiraoka, Pasadena, Calif.

[21] Appl. No.: 09/056,733

[22] Filed: Apr. 7, 1998

Related U.S. Application Data

[60] Provisional application No. 60/045,141, Apr. 30, 1997.

[51] Int. Cl.[6] ..... A47C 7/72

[52] U.S. Cl. ..... 297/4; 297/180.11; 5/654

[58] Field of Search ..... 297/4, 180.11, 297/180.12, 188.1, 452.41; 5/421, 654, 708

[56] References Cited

U.S. PATENT DOCUMENTS

| | | | |
|---|---|---|---|
| 1,468,072 | 9/1923 | Ogle | 297/4 |
| 1,830,570 | 11/1931 | Smith et al. | 5/654 X |
| 2,829,386 | 4/1958 | Peer | 297/4 X |
| 3,062,580 | 11/1962 | Jasmin, Jr. | 297/4 |
| 3,994,529 | 11/1976 | Lippert | 297/252 |
| 4,592,589 | 6/1986 | Hellwig | 297/284 |
| 4,781,413 | 11/1988 | Shumack, Jr. | 297/252 |
| 5,067,771 | 11/1991 | Ellis | 297/180.11 X |
| 5,275,315 | 1/1994 | Carmach et al. | 297/4 X |
| 5,487,197 | 1/1996 | Ishra, Jr. et al. | 297/452.41 X |
| 5,516,193 | 5/1996 | Simpson | 297/252 |
| 5,548,948 | 8/1996 | Smith et al. | 5/654 X |

*Primary Examiner*—Peter R. Brown

[57] ABSTRACT

An inflatable portable seat cushion for use when seated at various sporting events, winter activities, summer activities, and or any other occasion that might involve being seated for an undetermined amount of time and where seating is a hard and uncomfortable surface. An inflatable portable seat cushion attached to a pouch that can be located around a persons waist use to store the seat portion when not in use. The seat cushion may have a slip cover that covers the inflatable portion of the cushion that may be used to place personalized messages or advertising. When left deflated the seat cushion may be used to protect clothing from wet seating arrangements such as ski lifts, boating, or any other seating area that might become wet or damp. Located inside the inflatable portion of the seat cushion may be flexible heating elements that are operated by the use of common batteries for use in cold weather conditions. Attached to the seat portion can be either a hand pump and valve or mouth piece and valve used to inflate and deflate the seat portion.

1 Claim, 3 Drawing Sheets

INFLATABLE PORTABLE SEAT CUSHION WITH SLIP COVER AND POUCH

This application claims benefit of provisional app. 60/045,141 filed Apr. 30, 1997.

BACKGROUND OF THE INVENTION

1. Field of the Invention

The present invention relates to portable seats, and more particularly pertains to inflatable seat cushions attached to the waist of the user by means of a storage pouch with belt with the seat cushion removably attached to the pouch using VELCRO. The inflatable seat cushion of this invention is designed to be used by people who would like the comfort of a padded cushion and the convenience of not having to carry this cushion with their hands. When desired by the user, manufacture, or retailer the seat cushion can have personalized messages applied to the cushion or to the slip cover which can be applied over the seat cushion. When the user is standing up, the cushion, hanging from the users waist, will display the message.

2. Description of the Prior Art

By way of example, the prior art discloses in U.S. Pat. No. 4,781,413 to Shumack a Portable Stadium Seat for use over existing bleachers or stadium seats that has a rigid frame on which an inflatable cushion is provided.

U.S. Pat. No. 4,592,589 to Hellwig discloses a inflatable seat cushion intended as a training or helping device mainly for sitting upright without a back rest.

U.S. Pat. No. 3,994,529 to Lippert discloses a stadium chair assembly with pivotal legs and at least one pivotal holder located to swing downwardly to return the chair to a stadium bench with the legs folded up under the seat.

U.S. Pat. No. 5,516,193 to Simpson discloses a portable stadium seat apparatus with a back rest used in spectator events where the seating is flat benches without backs.

In this respect, the inflatable portable seat cushion with pouch according to the present invention substantially departs over current products of it's type because current inflatable seating products are large and cumbersome and need to be carried in a persons hand. Other portable padded seating products are made with fillers that do not collapse small enough to fit into a pocket or pouch.

SUMMARY OF THE INVENTION

In view of the disadvantages described in the prior art, the inflatable portable seat cushion of this invention overcomes many of the disadvantages of portable seating and has many applications other than just stadium seating.

The inflatable seat cushion is made from flexible, air tight, durable, materials formed to a square, oblong, round, or any other shape as would be preferred to any manufacture or consumer. Attached to the back and top edge of the seat cushion is a material strip or backing which has a VELCRO strip located at the top that would allow the cushion to be removably secured to the bottom of the pouch which is can be attached around a persons waist. To protect the seat cushion from dirt and damage, the seat cushion can be placed inside a slip cover. The slip cover is attached to the back of the cushion using common snap type fasteners or VELCRO. To add style to the slip cover, the slip cover can be used to advertise the consumers favorite athletic teams, business, logos, or any other form of advertising.

Located at the back or top edge of the seat cushion is an inflation tube and cap used to inflate the cushion, or a small hand pump with control valve. Located inside the cushion, attached to the inside upper portion, may be lightweight, flexible heating elements that are controlled by common batteries and an on/off switch. Manufactured into the center at various locations are indentations that allow the upper portion of the cushion to be attached to the lower portion of the cushion. This is to allow the seat cushion to keep its shape and form as determined by the manufacture.

To inflate the seat cushion using the hand pump, first the air control valve would be set in the closed position. Next, with hand pressure applied to the bulb pump, air is forced into the cushion until the firmness of the cushion is to the consumers liking. To deflate the cushion, simply turn the air control valve to the open position and allow the air to escape. To inflate cushion using the inflation tube, simply blow into inflation tube until desired firmness is achieved, than install the air cap into inflation tube. To deflate the cushion, simply remove the cap and allow the air to excape. The seat cushion can than be rolled up and stored in the pouch for protection and latter use.

The pouch in which the cushion may be stored is made from light weight water proof material and is formed to fit comfortably around a persons waist. Attached to the pouch is a belt and belt buckle used to hold the pouch in place while on a persons waist. The pouch can be made with many separate compartments of various sizes, but most importantly, the compartment located at the bottom of the pouch is to be large enough to hold and store the seat cushion. Located inside the bottom compartment is a Velcro strip used to hold the seat cushion removably in place. Located below the VELCRO strip is a zipper used to close the compartment when the deflated seat cushion is stored.

It is to be understood that the invention is not limited in its application to the details of the construction and to the arrangements of the members set forth in the following description or illustrations. It is also understood that those familiar with the manufacture and or methods of construction of the present invention or its members, may readily be utilized as a basis for the designing of other shapes, methods, and systems for carrying out the purpose of the present invention. It is important that the claims be regarded as including such similar construction insofar as they do not depart from the spirit and scope of the present invention.

DESCRIPTION OF THE PREFERRED EMBODIMENT

Figure 1:
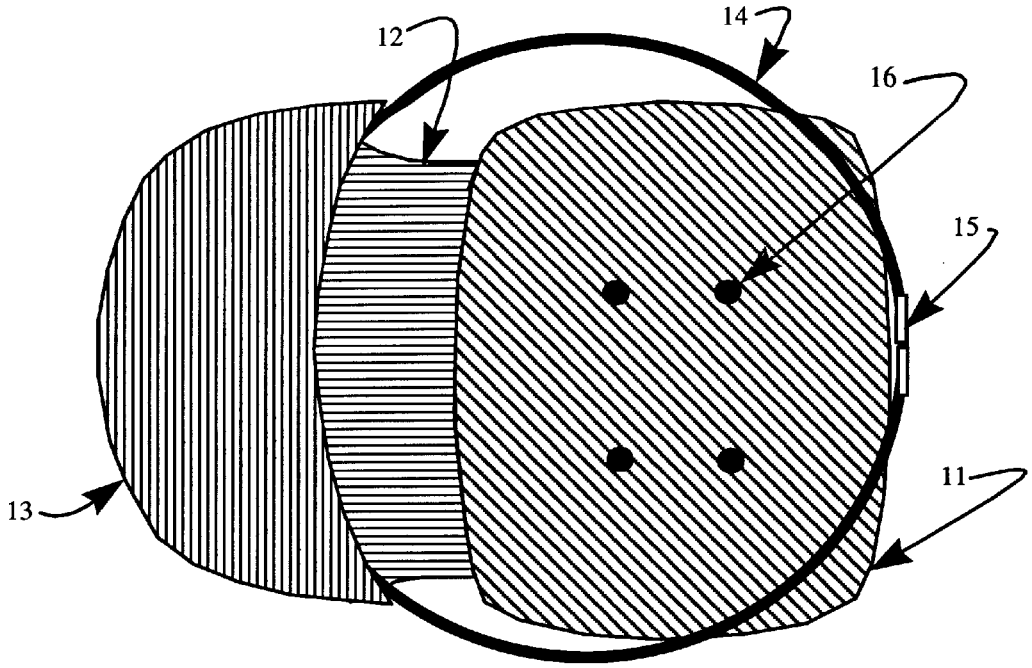
FIG. 1 is a view looking down at the top of invention.
Figure 2:
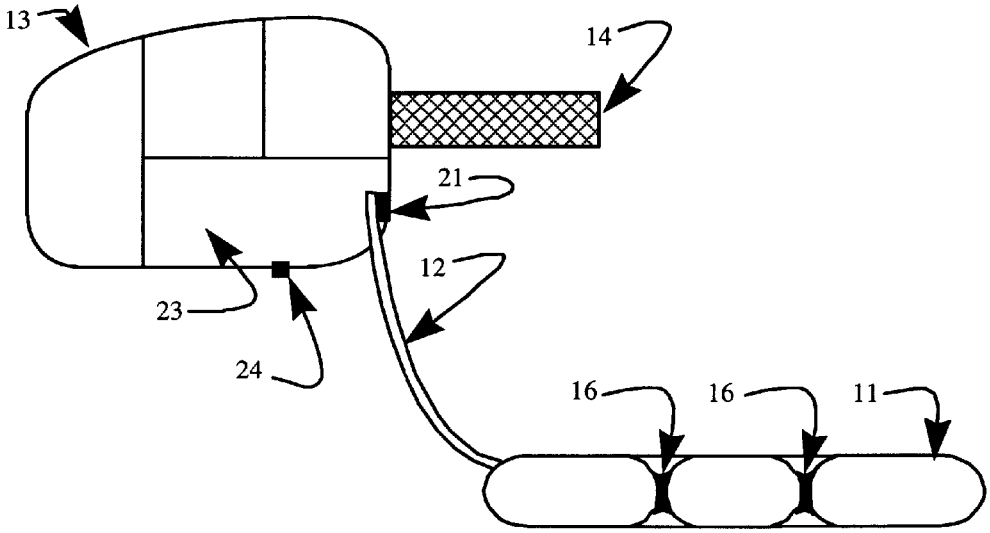
FIG. 2 is a view looking at the side of invention.

An inflatable portable seat cushion with heating element as shown in FIGS. 1 & 2 incorporating the improved design of the invention is shown in FIGS. 3–6 inclusive.

Referring first to FIG. 1, is seat cushion 11 made with through attachment points 16 to hold bottom and top of cushion 11 together. Attached to cushion 11 is back portion 12 which is in turn attached to pouch 13 using common VELCRO 21. Pouch 13 has adjustable belt 14 with buckle 15. All which make up preferred embodiment.

As shown in FIG. 2, is preferred embodiment attached to pouch 13 which has storage compartment 23 with zipper 24 to store cushion 11 with back portion 12 when not in use.

Figure 3:
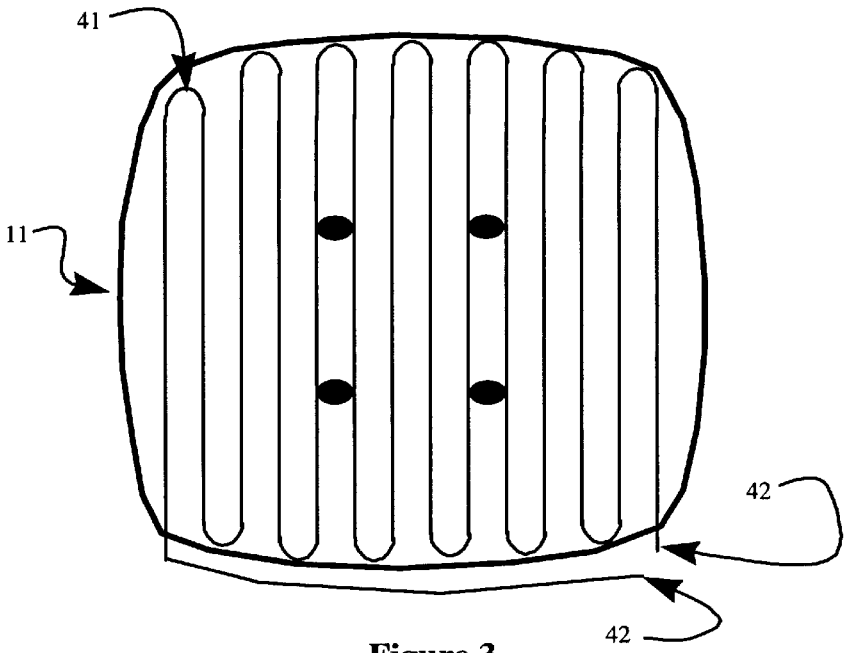
FIG. 3 is a view looking down at heating elements inside cushion.

As shown in FIG. 3, is seat cushion 11 as shown as preferred embodiment with heat element 41 and leads 42 that in turn make a complete circuit when attached to common battery 51.

Figure 4:
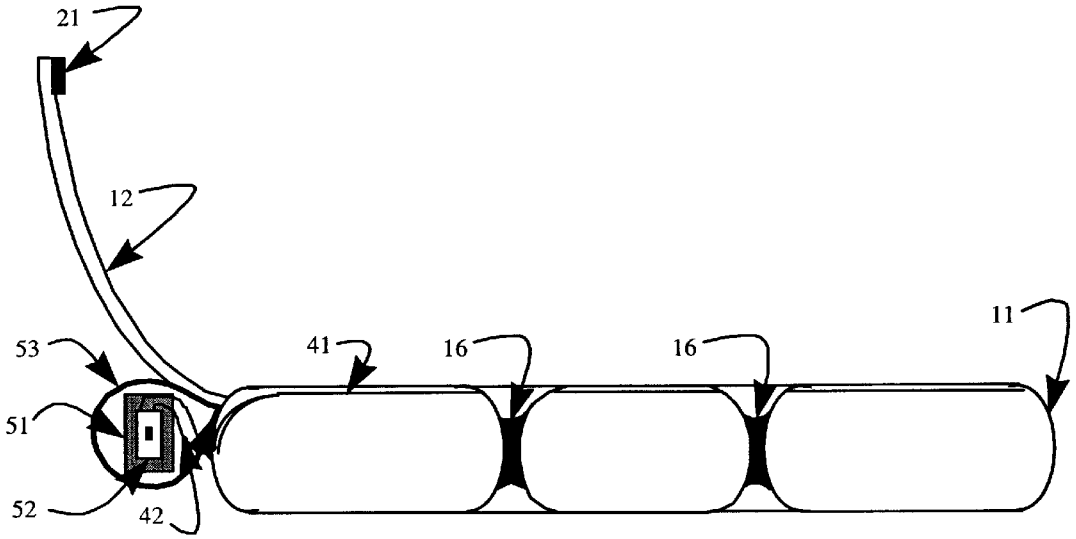
FIG. 4 is a view looking at the side of cushion with heating elements and on/off switch.
Figure 5:
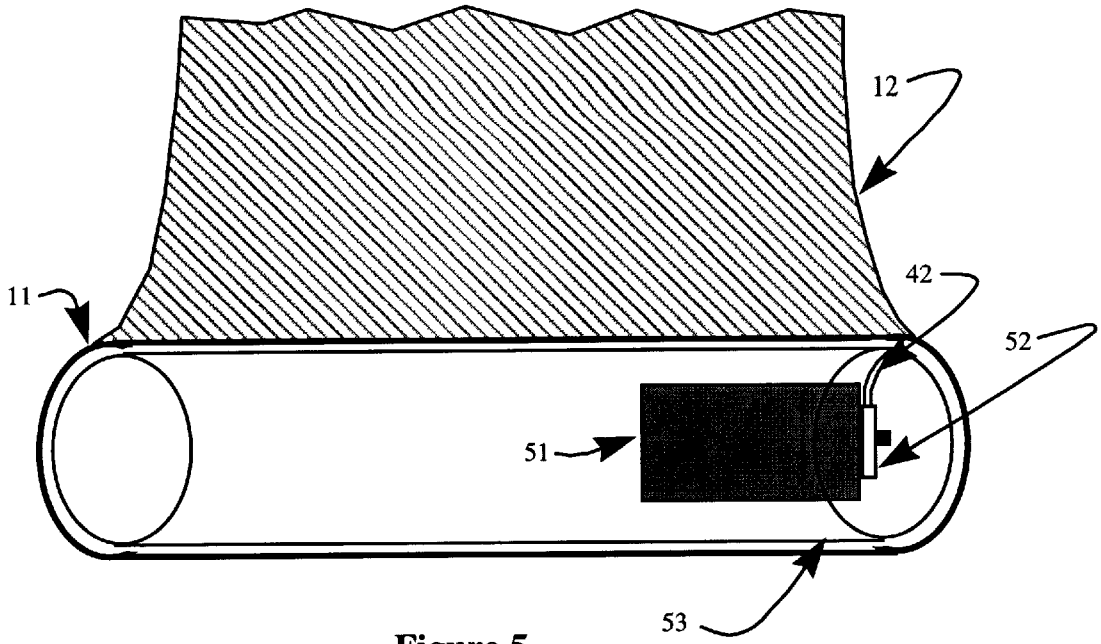
FIG. 5 is a view looking at the back of cushion batteries.
Figure 6:
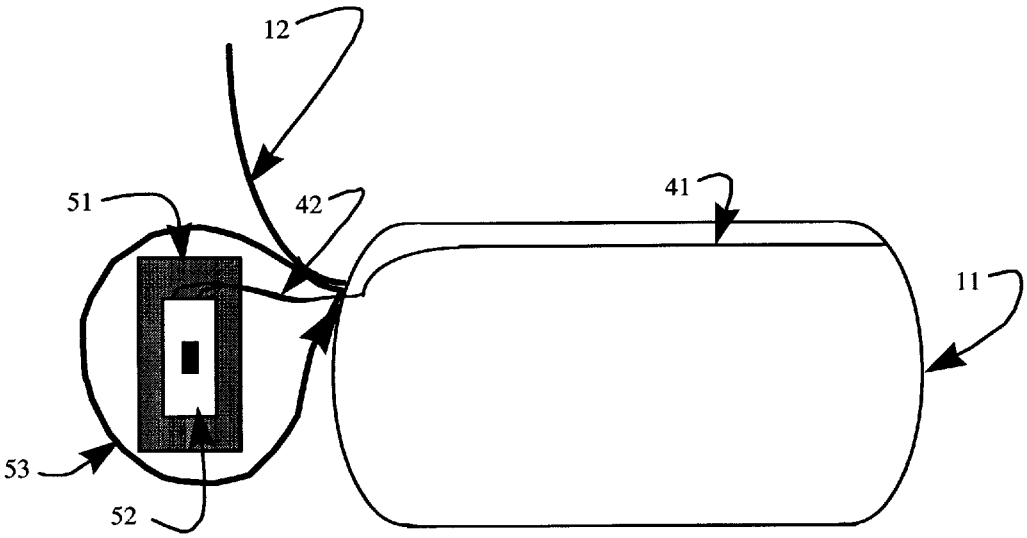
FIG. 6 is a detailed side view of battery and switch inside cloth tube.

As shown in FIG. 4 through 6, is seat cushion 11 as shown as preferred embodiment with heat elements 41 attached to common battery 51 using leads 42. Located at end of leads 42 and attached on top of battery 51 is on/off switch 52. Battery 51 is located inside tube 53 which is attached to cushion 11 under back portion 12.

It is to be understood that I do not desire to be limited to the exact details of construction or method shown herein since obvious modifications will occur to those skilled in the relevant arts without departing from the spirit and scope of the following claims.

What I claim is as follows:

1. A portable seat cushion assembly in combination with a waist pouch having an adjustable belt that is adapted to be worn around a user's waist; wherein said seat cushion assembly comprises an inflatable cushion member and a back portion extending therefrom which is detachably connected to the waist pouch; said seat cushion assembly further comprising a flexible heating element attached to an interior of said cushion member, an energizing element comprising a common battery having an on/off switch operably connected to the heating element, and a cloth tube that is attached to an exterior of said cushion member and within which the battery is stored; said waist pouch having an interior compartment in which the seat cushion assembly is stowed when not in use.

* * * * *